US006732628B1

(12) United States Patent
Coburn et al.

(10) Patent No.: US 6,732,628 B1
(45) Date of Patent: May 11, 2004

(54) PORTABLE BULLET TRAP

(75) Inventors: Ronald Coburn, Spofford Lake, NH (US); Wayne A. Bush, Russell, MA (US)

(73) Assignee: Savage Range Systems, Inc., Westfield, MA (US)

( * ) Notice: Subject to any disclaimer, the term of this patent is extended or adjusted under 35 U.S.C. 154(b) by 0 days.

(21) Appl. No.: 09/878,601

(22) Filed: Jun. 11, 2001

(51) Int. Cl.[7] ..... F41H 5/02
(52) U.S. Cl. ..... 89/36.02
(58) Field of Search ..... 89/36.02

(56) References Cited

U.S. PATENT DOCUMENTS

| | | | | | |
|---|---|---|---|---|---|
| 3,664,263 | A | * | 5/1972 | Driscoll | |
| 4,445,693 | A | * | 5/1984 | Angwin | 273/404 |
| 4,482,027 | A | * | 11/1984 | Gould | 181/223 |
| 4,787,289 | A | * | 11/1988 | Duer | 89/36.02 |
| 4,846,043 | A | * | 7/1989 | Langsam | 89/1.1 |
| 5,070,763 | A | | 12/1991 | Coburn | 89/36.02 |
| 5,110,661 | A | * | 5/1992 | Groves | 89/36.02 |
| 5,113,700 | A | | 5/1992 | Coburn | 89/36.02 |
| 5,121,671 | A | | 6/1992 | Coburn | 89/36.02 |
| 5,364,679 | A | * | 11/1994 | Groves | 89/36.02 |
| 5,486,008 | A | | 1/1996 | Coburn | 273/410 |
| 5,684,264 | A | * | 11/1997 | Cassells et al. | 89/1.1 |
| 5,988,647 | A | * | 11/1999 | Porter et al. | 89/36.02 |
| 6,016,735 | A | * | 1/2000 | Langner | 89/36.02 |
| 6,128,847 | A | * | 10/2000 | Langner | 42/106 |

FOREIGN PATENT DOCUMENTS

| | | | | |
|---|---|---|---|---|
| FR | 865 464 | * | 5/1941 | 89/36.02 |
| FR | 2 465 186 | * | 3/1981 | 89/36.02 |

OTHER PUBLICATIONS

English translation of France 865.464.*
Advertisement for Forensic Buddy by Snail Systems 2001, 2 pages.

* cited by examiner

*Primary Examiner*—Stephen M. Johnson
(74) *Attorney, Agent, or Firm*—MacCord Mason PLLC

(57) ABSTRACT

A bullet trap for arresting and trapping a fired bullet. The bullet trap includes a primary enclosure having a shooting port and a plurality of discrete, resilient bullet trap media in the enclosure. In the preferred embodiment, the media are generally spherical and have a durometer less than or equal to about 100. The media is operable to arrest and capture a fired bullet in a sufficiently small enclosure so as to be portable.

55 Claims, 12 Drawing Sheets

PORTABLE BULLET TRAP

BACKGROUND OF THE INVENTION (1) Field of the Invention

The present invention relates generally to bullet traps, and more particularly, to a safe, portable and inexpensive bullet trap for arresting and capturing bullets fired from handguns or other small firearms which leaves the bullets in a condition suitable for ballistic fingerprint analysis.

(2) Description of the Prior Art

Bullet traps per se are well known devices which have been used for many years by firearm manufacturers and users (the latter including firing ranges operated by military installations, police departments, rifle and pistol clubs, and the like) who are faced either with the need to proof, function fire and target firearms such as handguns, rifles and shotguns or with the task of simply collecting spent bullets fired on a range. The objectives of such devices have been to provide means located at a relatively short distance from the shooter to catch the lead or other types of bullets (jacketed or unjacketed) and prevent either the ricochet of a whole bullet or a large fragment thereof or the backsplattering of numerous small metal particles, which could return with enough energy to cause injury to the shooter or innocent bystanders and to collect the waste lead, brass and jacket material. The known types of bullets traps have run the gamut from wood boards to sand-filled boxes to metallic funnel and deceleration chamber combinations.

Merely by way of example, a known sand-type bullet trap consists of a quantity of sand in a hardwood box set against a concrete backstop or wall. However, a bullet trap of this class has a number of drawbacks and disadvantages, both in terms of its structural and functional characteristics and in terms of the expenses associated with it. The material requirements for the box are, for example, 640 linear feet per year of 2".times.8".times.10' hardwood, and 45 cubic yards per year of sand. Annual maintenance requires 8 man-hours per week for 50 weeks. Disposal of such a sand/wood trap and accumulated waste requires handling a load of about 15 tons per year, including transportation to a landfill. Assuming 5–6 loads per year, annual expenditures at current costs (including labor) come to about $30,000 plus the cost of the sand and hardwood, for an aggregate total of about $40,000. Moreover, under current environmental laws, lead has been banned from landfills unless it has first been treated to meet new disposal standards, and the separation of lead from the sand and the detoxification treatment thereof (e.g., a thermal oxidation, which has been proposed for this purpose) can easily double or triple the disposal costs.

On the other hand, the mechanical bullet traps of the funnel and deceleration chamber type, which came onto the market about a century or so ago, were specifically designed to deal with some of the problems that were inherent to the sand-filled box types of traps. Some representative relatively simple bullet trap constructions of the funnel and chamber type are disclosed in U.S. Pat. No. 385,546 (Decumbus 1888); U.S. Pat. No. 694,581 (Reichlin 1902); U.S. Pat. No. 840,610 (Easdale 1907); U.S. Pat. No. 2,013,133 (Caswell 1935); and U.S. Pat. No. 4,126,311 (Wagoner 1978). Somewhat more sophisticated bullet trap constructions are disclosed in U.S. Pat. No. 2,772,092 (Nikoden 1956); U.S. Pat. No. 3,737,165 (Pencyla 1973; U.S. Pat. No. 4,512,585 (Baravaglio 1985); and U.S. Pat. No. 4,821,620 (Cartee et al. 1989).

Savage Range Systems (SRS) of Westfield, Mass. markets an innovative line of bullet traps under the mark SNAIL® SYSTEMS. These bullet traps are disclosed in U.S. Pat. Nos. 5,486,008; 5,070,763; 5,113,700 and 5,121,671 to Coburn. The SNAIL® bullet traps address many of the aforementioned shortcomings of earlier bullet traps. The SNAIL® bullet traps are relatively inexpensive to manufacture, can be constructed for transportability and ease of installation, and do not require the provision of thick walls, sand mounds or other back-up structures. The SNAIL® traps are multi-functional, and may be used for proofing, function firing and targeting for both small and high-powered firearms. Generally, these traps include a narrowing passageway that directs a fired bullet into a deceleration chamber. The deceleration chamber has a generally spirally curved circumferential boundary wall that guides the bullet in a circular path along the boundary wall until the bullet eventually decelerates and falls into a collecting vessel. A lubricating fluid may be included in the deceleration chamber.

However, none of the above-mentioned bullet traps are suitable for ballistic testing of a firearm. Ballistic testing of firearms is an established forensic technique used to match a specific bullet to a particular firearm. The ballistic markings created on a bullet by a particular firearm are unique. Therefore, law enforcement personnel can accurately match a bullet from a crime scene with a particular firearm. This requires a suspected firearm to be test fired and a test bullet recovered which has been left substantially intact after firing. The markings on the test bullet can then be compared to the markings on a bullet from a crime scene to determine if the bullets were fired from the same firearm. Any additional scratches or marks imparted on a test bullet by the bullet-capture and recovery process may compromise or invalidate the bullet's "signature" or "fingerprint." Accordingly, a method is needed to trap a bullet from a firearm in a way that does not alter or obliterate the ballistic markings on the bullet.

In addition, the above-mentioned bullet traps almost always damage or even fragment the trapped bullets during the trapping process, and are therefore ineffective for forensic ballistics testing. Instead, forensic laboratories have historically test-fired firearms for ballistics testing into a drum, tank, or vessel containing water. A large volume of water is necessary to decelerate a fired bullet sufficiently to arrest the bullet without significant damage to the ballistic markings on the bullet. However, such water traps have certain limitations. Recovery of a fired bullet from such a vessel can be difficult and often messy. In addition, the lead-contaminated water must be disposed of in an environmentally safe manner. The water-filled vessels are typically large and heavy, and difficult to transport. Thus, such bullet traps cannot be easily transported directly to crime scenes for on-the-spot ballistic testing of suspected firearms.

Furthermore, several state legislatures have recently enacted or are presently considering laws that require newly sold handguns to be test-fired before they are sold in order to collect a spent bullet and/or shell casing from each such handgun. Under a typical so-called "ballistic fingerprinting" law, the characteristic markings or "ballistic fingerprints" on the spent bullets and/or shell casings from newly sold handguns are to be entered into a database which is accessible to law enforcement. In this way, proponents of such laws anticipate that law enforcement can more quickly and efficiently correlate evidence from a crime scene with a particular handgun and handgun owner. As a result, such laws heighten the need for a safe, inexpensive, portable, and easy-to-use bullet trap for collecting an undamaged sample bullet from handguns and other small firearms.

Thus, there remains a need for a new and improved bullet trap which is sufficiently lightweight so as to be portable while, at the same time, leaves trapped bullets substantially intact.

SUMMARY OF THE INVENTION

The present invention is directed to a bullet trap for arresting and trapping a fired bullet. The bullet trap includes a primary enclosure having a shooting port and a plurality of discrete, resilient bullet trap media in the enclosure. In the preferred embodiment, the media are generally spherical and have a durometer less than or equal to about 100. The media is operable to arrest and capture a fired bullet in a sufficiently small enclosure so as to be portable.

In the preferred embodiment, the bullet trap further includes a secondary enclosure for containing the plurality of discrete, resilient bullet trap media. The secondary enclosure includes sidewalls and a bottom. In the preferred embodiment, the secondary enclosure has a circular cross-section which generally corresponds to the inside diameter of the primary enclosure.

Also, in the preferred embodiment, the secondary enclosure includes a removable cap on the bottom of the secondary enclosure for aiding in filling the secondary enclosure with the media. The secondary enclosure further includes a top having a sacrificial plug which may be replaced after the fired bullets have sufficiently damaged the sacrificial plug.

In the preferred embodiment, the secondary enclosure is constructed of a resilient material which "gives" or expands when the bullet is fired into the bullet trap. Also, in the preferred embodiment, the resilient material is translucent plastic which aids in determining that the secondary enclosure includes a sufficient volume of media to arrest and capture the fired bullet.

Preferably, the primary enclosure includes sidewalls and a back opposite the shooting port and has an inside diameter complementary to receive the secondary enclosure, when used. The back may further include a removable, bullet impact-resistant safety door. The bullet trap may also further include a carrying handle attached to the primary enclosure, end supports attached to the primary enclosure and means for attaching the end supports to a surface.

The primary enclosure may further include a vent port in the primary enclosure for aiding in venting gases and smoke from the fired firearm. A safety cover on the shooting port also helps to keep gases away from the user of the firearm.

The media are less than or equal to about 2 inches in diameter and greater than about ⅛ inch in diameter and, preferably, the diameter of the media is between about ¼ inch and ¾ inch with a diameter of about ⅝ inch being most preferred.

The media also have a durometer greater than about 5 and, preferably, the media have a durometer between about 30 and 40 with a durometer of about 40 being most preferred.

The volume of the discrete bullet trap media in the enclosure is chosen to be sufficient to arrest a bullet fired through the shooting port. Preferably, the height of the enclosure is greater than about 3 inches with a height of the enclosure of about 16 inches being most preferred. Preferably, the diameter of the enclosure is greater than about 3 inches with a diameter of the enclosure of about 7 inches being most preferred.

Accordingly, one aspect of the present invention is to provide a bullet trap for arresting and trapping a fired bullet, the bullet trap including: a primary enclosure having a shooting port; and a plurality of discrete, resilient bullet trap media in the enclosure; whereby the media is operable to arrest and capture a fired bullet.

Another aspect of the present invention is to provide an improved bullet trap for arresting and trapping a fired bullet, the bullet trap including a primary enclosure having a shooting port; and bullet trap media in the enclosure; whereby the media is operable to arrest and capture a fired bullet, the improvement being: discrete bullet trap media in the primary enclosure which are generally spherical and have a durometer less than or equal to about 100.

Still another aspect of the present invention is to provide a bullet trap for arresting and trapping a fired bullet, the bullet trap including: a primary enclosure having a shooting port; a plurality of discrete, resilient bullet trap media in the enclosure, which are generally spherical and have a durometer less than or equal to about 100; whereby the media is operable to arrest and capture a fired bullet; and a secondary enclosure for containing the plurality of discrete, resilient bullet trap media.

These and other aspects of the present invention will become apparent to those skilled in the art after a reading of the following description of the preferred embodiment when considered with the drawings.

DESCRIPTION OF THE PREFERRED EMBODIMENTS

Figure 1:
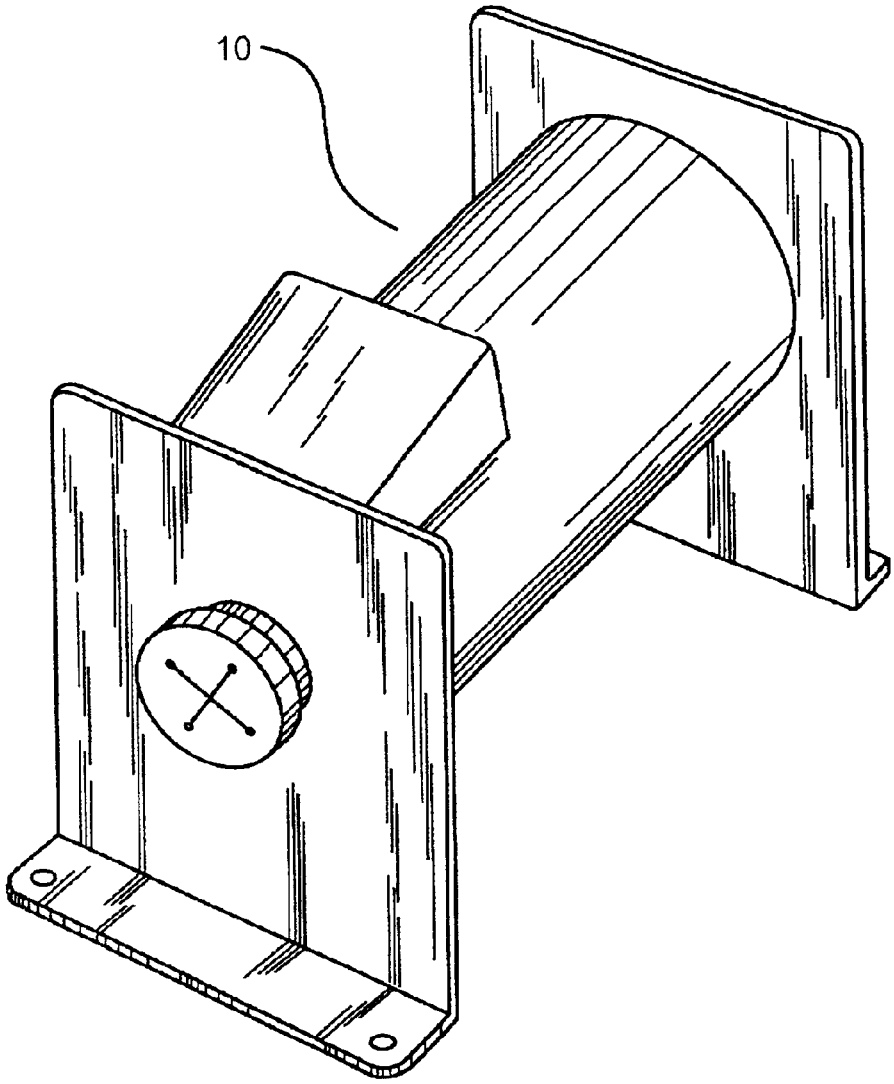
FIG. 1 is a perspective view of a bullet trap constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a portable bullet trap, generally designated 10, is shown constructed according to the present invention. The bullet trap 10 includes three major sub-assemblies: an enclosure with a shooting port 12; a plurality of discrete resilient bullet media 16; and a secondary enclosure 20.

Figure 2:
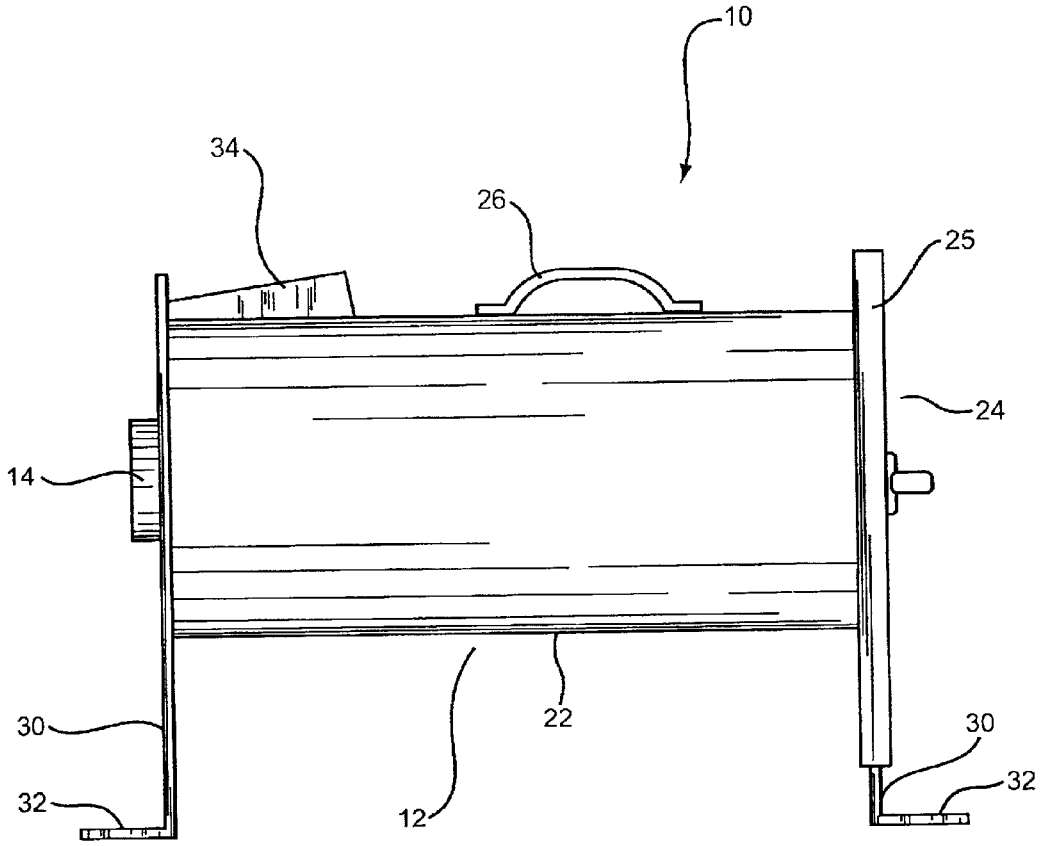
FIG. 2 is a side view of the bullet trap shown in FIG. 1.

As best seen in FIG. 2, the enclosure 12 includes sidewalls 22 and a back 24 opposite the shooting port 12. Preferably, the sidewalls 22 are circular in cross section. The back 24 of the enclosure 12 includes a bullet impact-resistant safety/access door 25, which is removable. The enclosure 12 may include a carrying handle 26 and end supports 30 on each end. An attachment means 32 is provided for mounting the bullet trap to a base or foundation. Preferably, the attachment means 32 includes holes in a lower portion of the end supports 30 for screwing or bolting the bullet trap to surface. A vent port 34 is provided on an upper portion of the enclosure 12 to permit gases to safely exit the enclosure 12. Preferably, the enclosure 12, sidewalls 22, back 24, safety/access door 25, and end supports 30, and vent port 34 are constructed of steel or other suitable metal or alloy.

Figure 3:
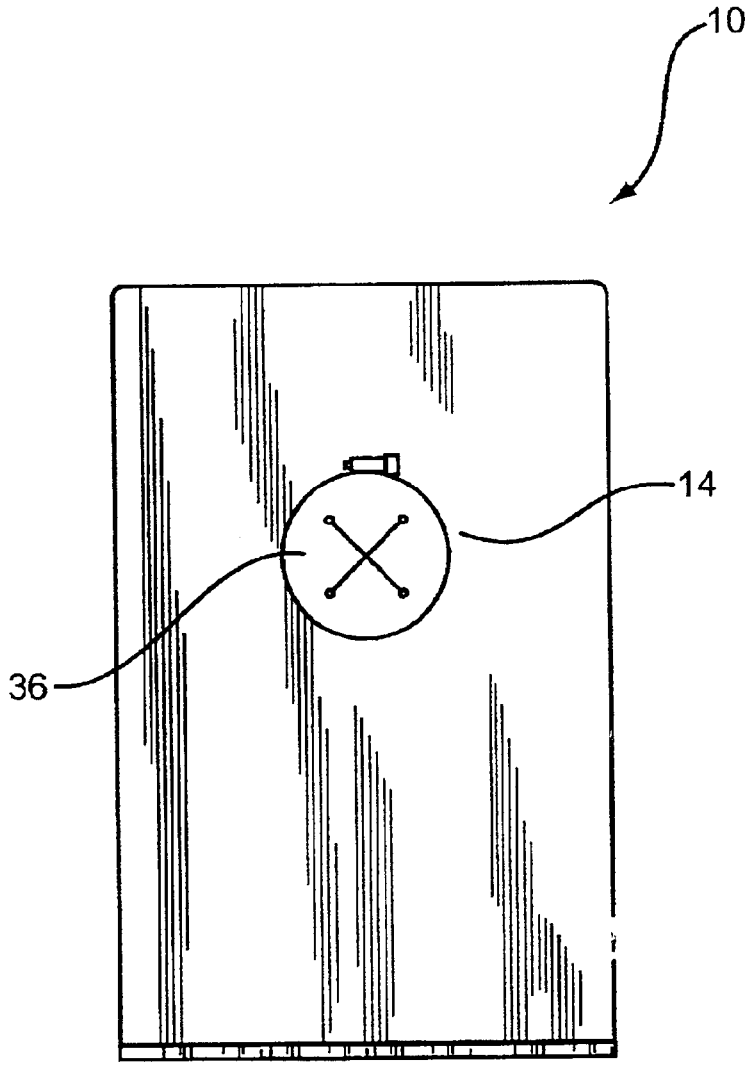
FIG. 3 is a front view of the bullet trap shown in FIG. 1.

As seen best in FIG. 3, a safety cover 36 is provided on the shooting port 14. Preferably, the safety cover 36 is flexible and is slotted to allow insertion of the muzzle of a firearm while maintaining a closure sufficient to inhibit the exit of gases, lead dust, or debris from the enclosure 12 through the shooting port 14.

Figure 4A:
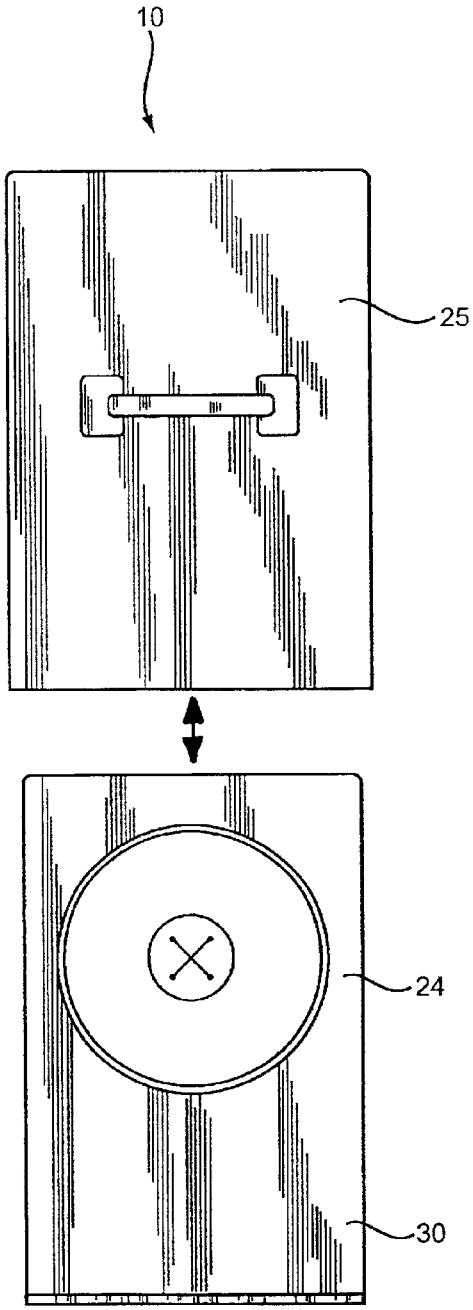
FIG. 4A is a back view of the bullet trap shown in FIG. 1 with the safety door removed.
Figure 4B:
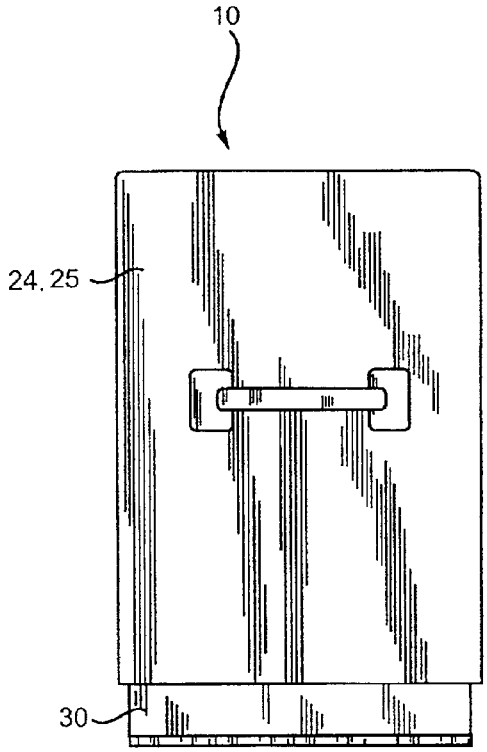
FIG. 4B is a back view of the bullet trap shown in FIG. 1 with the safety door installed.

As seen best in FIGS. 4A and 4B, the safety access door 25 can be removed to permit access to the interior of the enclosure 12. In the preferred embodiment, the safety door 25 slides over the end support 30.

Figure 5:
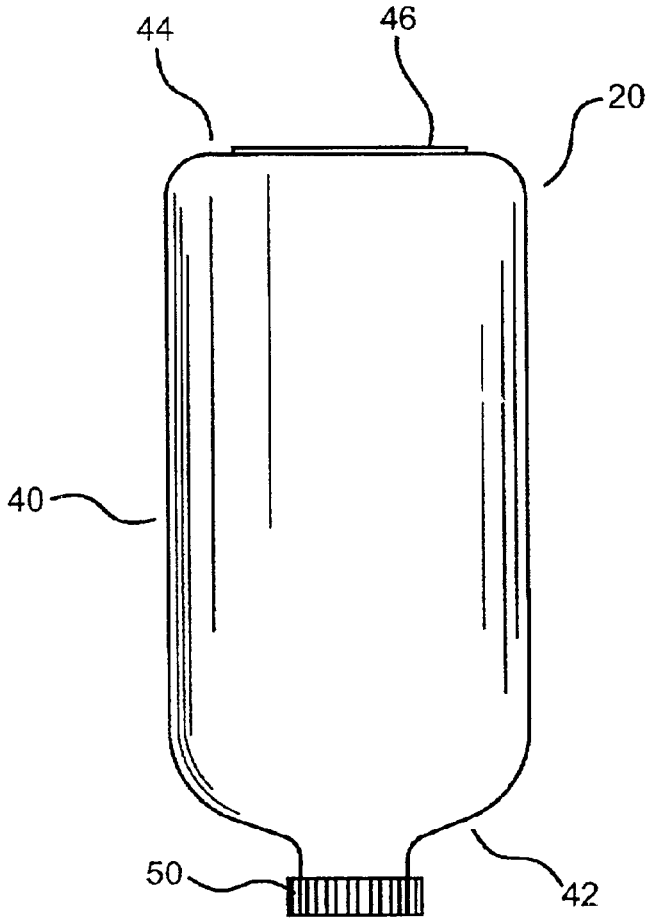
FIG. 5 is a side view of the secondary enclosure containing the bullet trap media.
Figure 6:
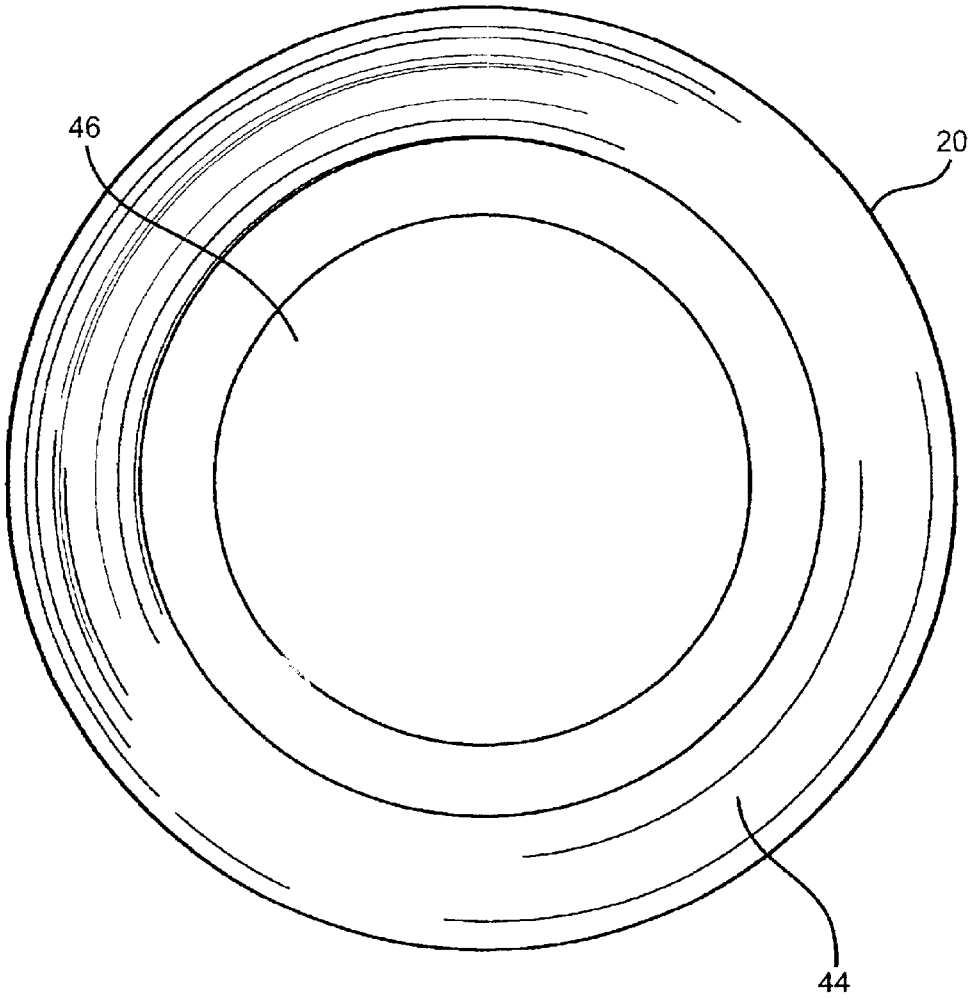
FIG. 6 is a top view of the secondary enclosure shown in FIG. 6 with the sacrificial plug installed.
Figure 7:
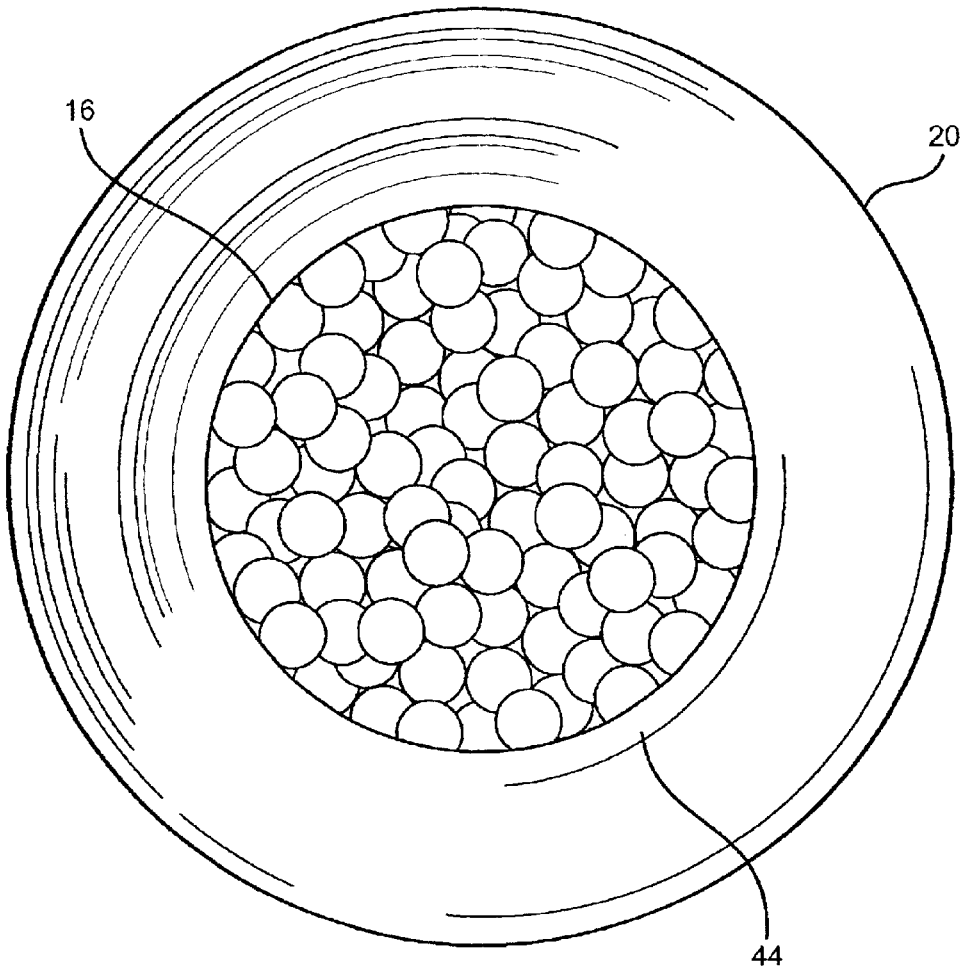
FIG. 7 is a top view of the secondary enclosure shown in FIG. 6 with the sacrificial plug removed.
Figure 9:
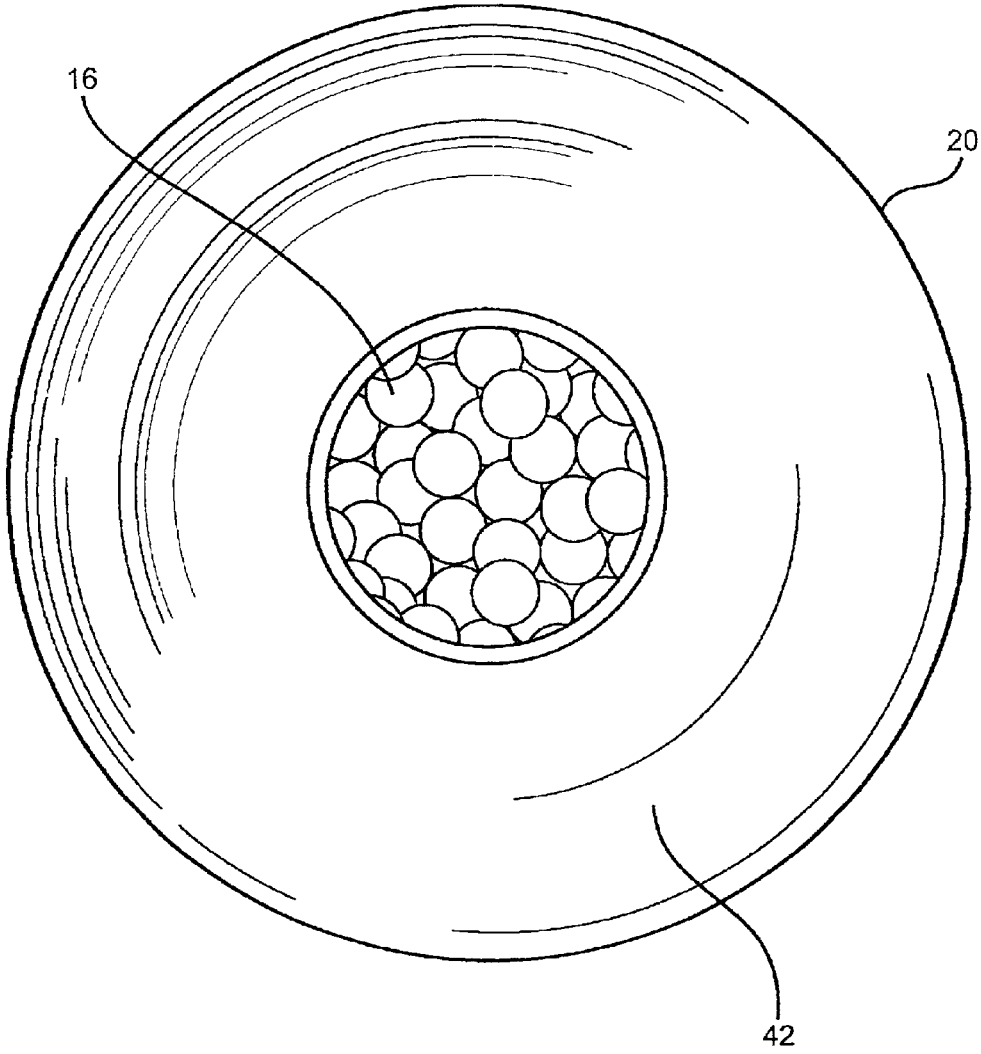
FIG. 9 is a bottom view of the secondary enclosure shown in FIG. 6 with the removable cap removed.
Figure 10:
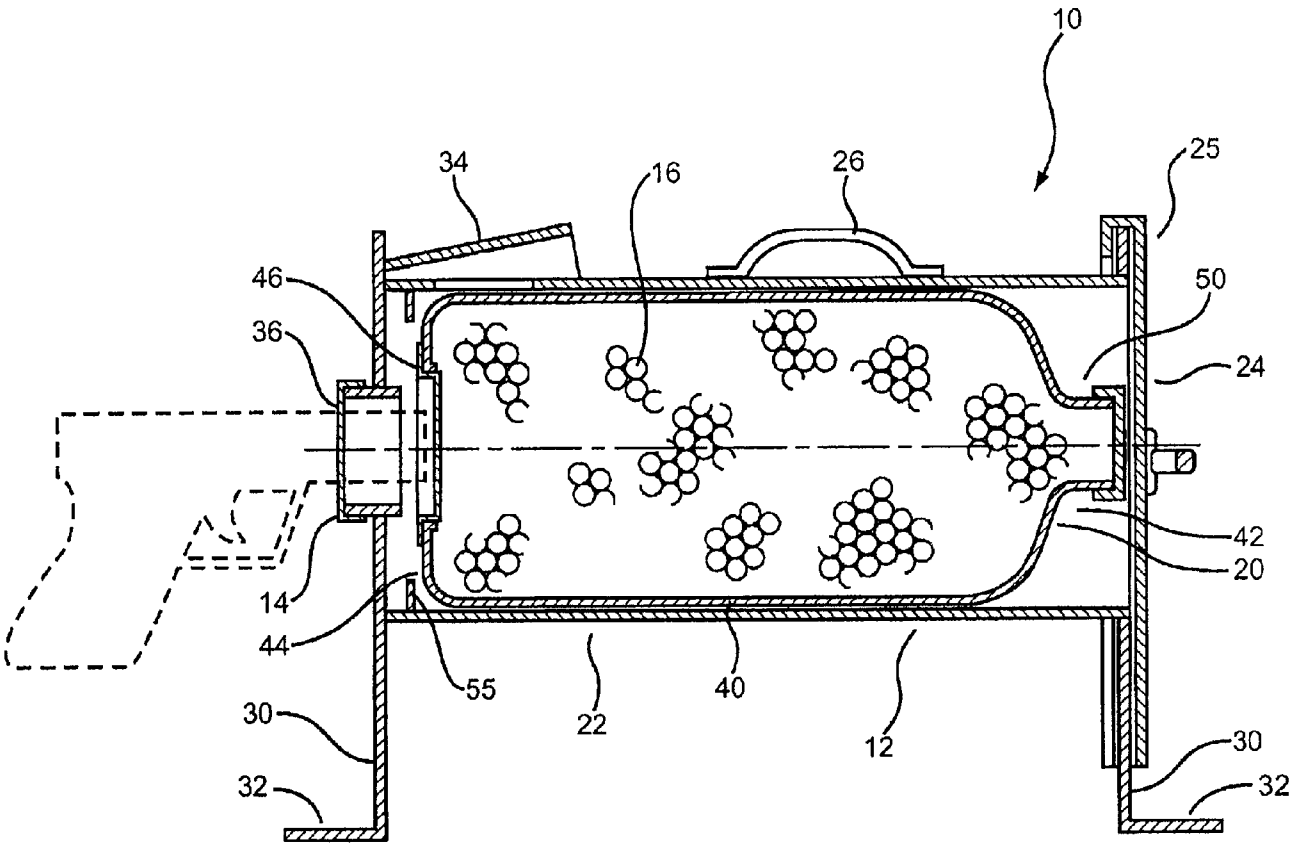
FIG. 10 is a side cross-sectional view of the bullet trap shown in FIGS. 1 and 2 illustrating the complete assembly of the bullet trap.

As seen in FIG. 5, the preferred embodiment of the present invention includes a secondary enclosure 20 having sidewalk 40 and a bottom 42. The bottom may include a removable cap 50. As seen best in FIGS. 6 and 7, the secondary enclosure 20 may also include a top 44 which may include a sacrificial plug 46 in an opening in the top 44. Preferably, sidewalls 40 of the secondary enclosure 20 are circular in cross section. Also, the secondary enclosure 20 is preferably constructed of a resilient material, which is translucent or transparent. As seen in FIGS. 7, 9, and 10, discrete bullet trap media 16 are provided in the secondary enclosure 20.

Figure 8:
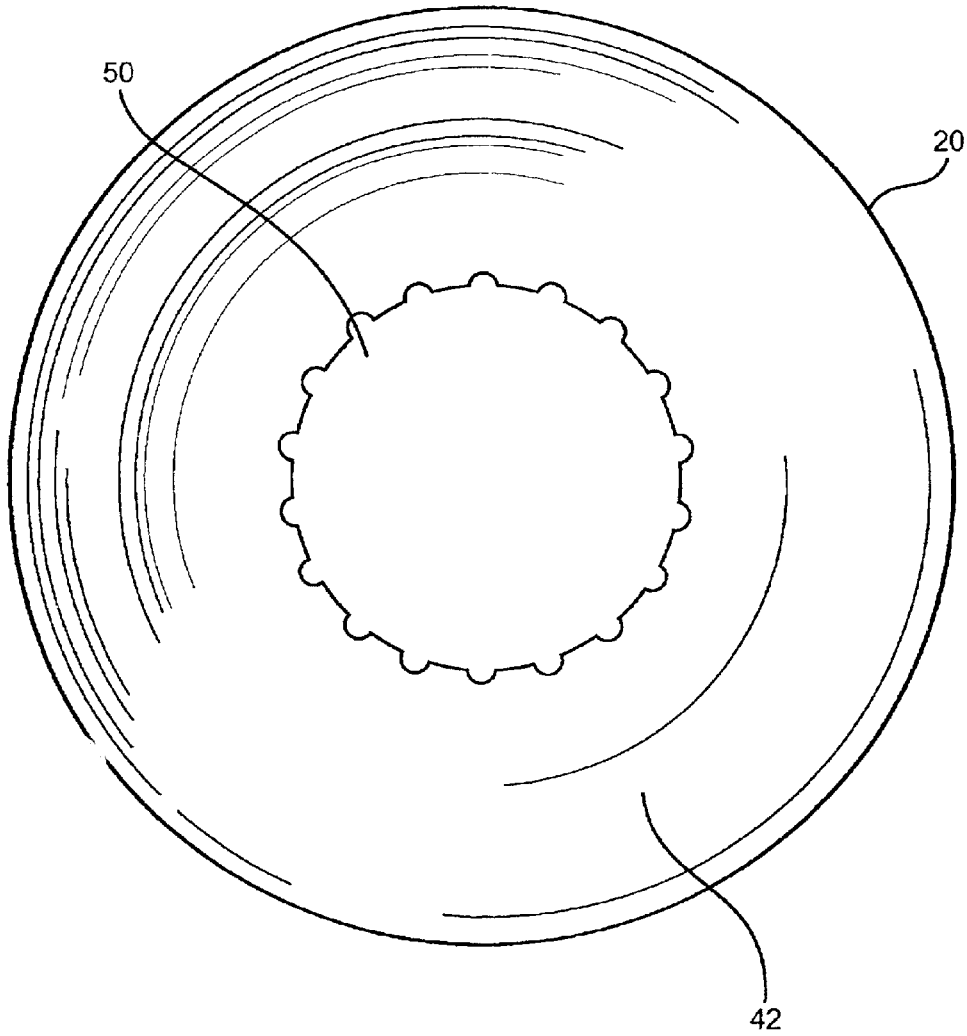
FIG. 8 is a bottom view of the secondary enclosure shown in FIG. 6 with the removable cap in place.

FIGS. 8 and 9 show the bottom of the secondary enclosure. Removal of the removable cap 50 from the secondary enclosure 20 permits insertion/removal of the discrete bullet trap media 16 into/from the secondary enclosure 20. As seen best in FIGS. 4A and 4B, the safety access door 25 can be removed to permit access to the interior of the enclosure 12 for inserting/removing the secondary enclosure 20 into/from the enclosure 12.

The complete assembly and operation of the bullet trap 10 is best seen in the cross-sectional view of FIG. 10. The secondary enclosure 20 containing the bullet trap media 16 is inserted into the enclosure 12 through the back 24 after removing the safety/access door 25. The secondary enclosure 20 is inserted so that its top 44 is adjacent to the shooting port 14. A stop 55 prevents the secondary enclosure from contacting the shooting port, thereby restricting the muzzle blast from a firearm fired in the bullet trap. The achieved spacing prevents "blow back" in the direction of the shooter and provides a space for proper venting through the vent 34. Once the secondary enclosure 20 is inserted into the enclosure 12, the safety/access door 25 is installed over the back 24 of the enclosure 12. The safety/access door 25 retains the secondary enclosure 20 in the enclosure 12, and provides a positive stop for a bullet should the bullet pass out of the secondary enclosure 20.

In operation, the muzzle of a firearm is inserted through the safety cover 36 on the shooting port 14 until the muzzle of the firearm is against or near the sacrificial plug 46. The shooting port 14 may be lined rubber (not shown) to cushion any contact between the firearm and the shooting port 14 resulting from recoil of the firearm when fired. The firearm is discharged causing a bullet to pass through the sacrificial plug 46 and into the discrete bullet trap media 16. The length of the secondary enclosure 20 is such that there is about a 0.25 inch gap between the cap 50 and the safety/access door 25, so that the secondary enclosure 20 cannot move as a result of the muzzle blast. Gases and smoke from the discharge of the firearm pass from the enclosure 12 through the vent 34 on the enclosure. The vent port 34 is configured to direct any exiting gases away from a person shooting the firearm into the bullet trap 10. To retrieve the bullet, the safety access door 25 is removed and the secondary enclosure 20 is withdrawn from the enclosure 12 through the back 24 of the enclosure 12. The removable cap 50 is removed from the bottom 42 of the secondary enclosure 20, and the bullet trap media 16 containing the bullet are emptied from the secondary enclosure 20. The bullet is located and removed from the media 16.

Figure 11:
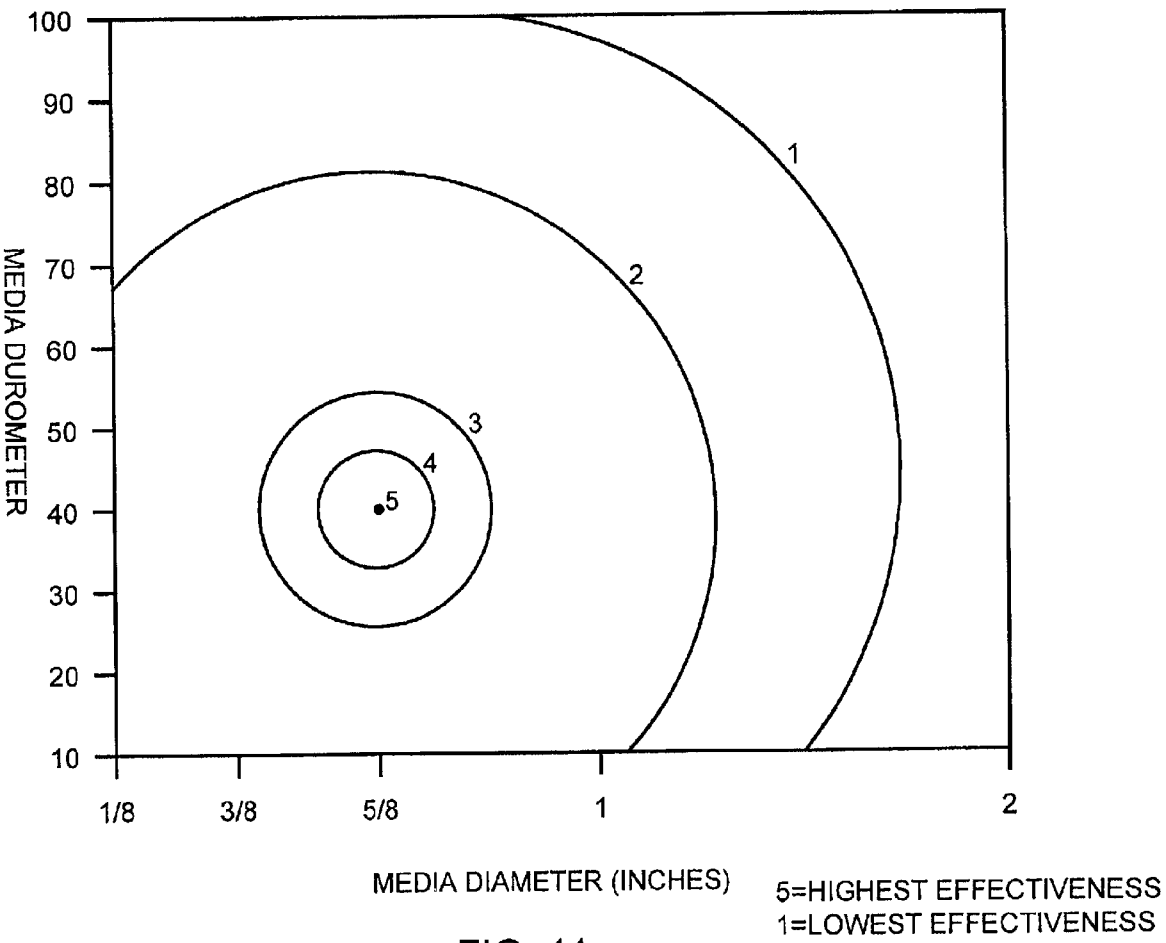
FIG. 11 is a graph showing the effects of bullet trap media durometer and media diameter on the relative effectiveness of the bullet trap media to arrest and capture a bullet.

As best seen in FIGS. 7 and 9, the bullet trap media 16 are preferably spherical. While not fully understood, it is believed that media having "soft" or "rounded" edges are most effective because they do not impart excessive friction on the bullet and therefore don't scar the bullet surfaces. The preferred media have a spherical diameter of about ⅝ inch and have a durometer of about 40. However, other shapes and diameters of media may also be used. Media having different durometers may, likewise, be used. FIG. 11 is a graph showing the effect of bullet trap media durometer and media diameter on the effectiveness of the media to arrest a bullet with minimal damage to the media. Media having diameters up to 2 inches and having durometers up to 100 may be used in the invention. Preferably, the discrete bullet trap media 16 are darker in color than a bullet to facilitate visually locating a bullet in the media.

Figure 12:
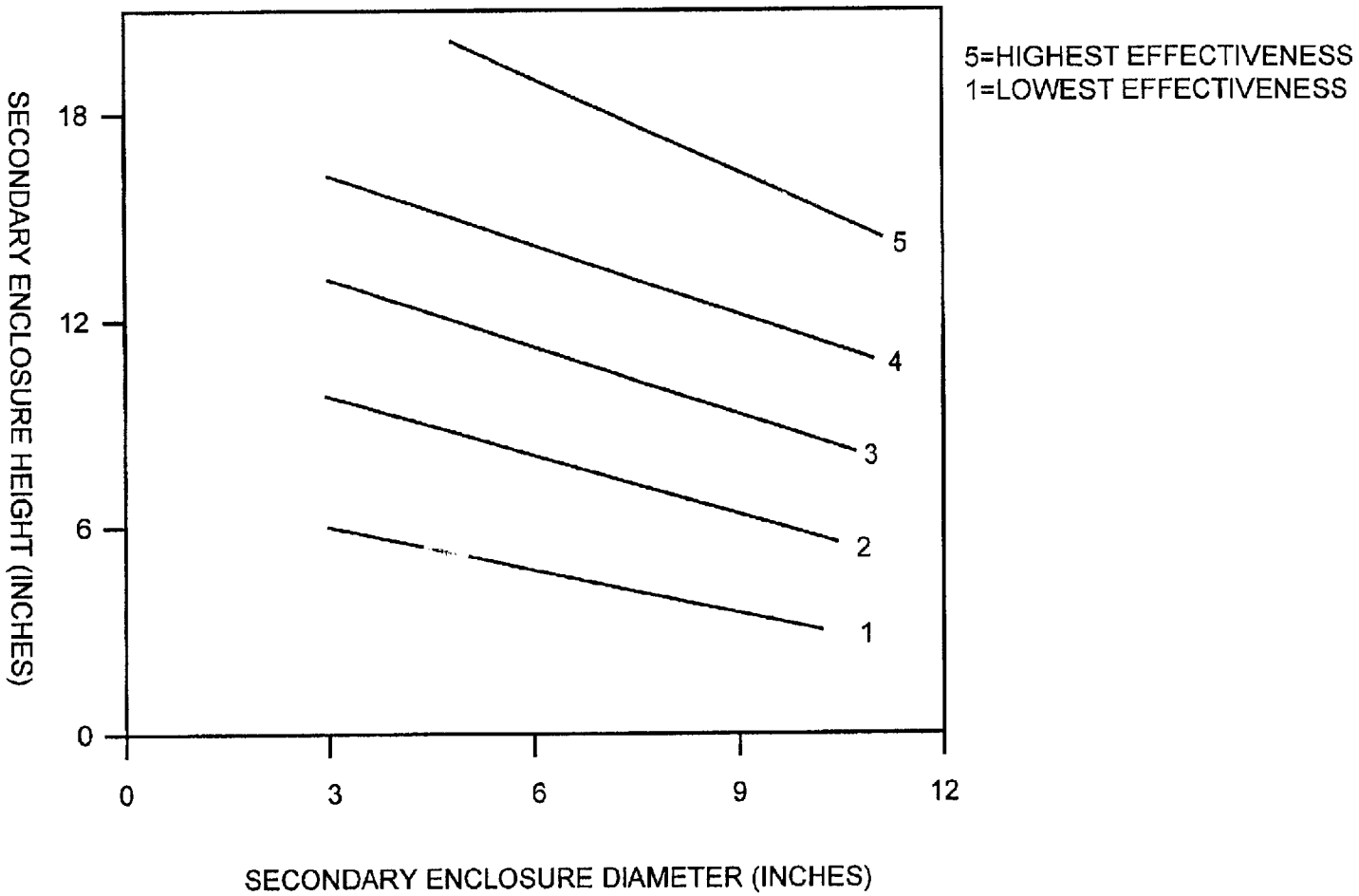
FIG. 12 is a graph showing the effects of enclosure height and enclosure diameter on the relative effectiveness of the bullet trap to arrest and capture a bullet.

The volume of the bullet trap media 16 must be sufficient to arrest a bullet. In a preferred embodiment, the diameter of the secondary enclosure is about 7 inches, and the height of the secondary enclosure is about 16 inches. FIG. 12 is a graph depicting the effect of height and diameter of the secondary enclosure on the effectiveness to arrest a bullet. Other heights and diameters that provide a sufficient volume of media to arrest a bullet may be used in the invention.

Certain modifications and improvements will occur to those skilled in the art upon a reading of the foregoing description. By way of example, the enclosure and secondary enclosure may have square or other suitable cross-sections. The enclosures might also include means for quickly opening or closing the enclosures such as snap-on lids or hinged or swiveling doors. In addition, the bullet trap media may be cylindrical or ellipsoidal rather than spherical. Also, the bullet trap may have a larger volume than the preferred embodiment described above to accommodate higher power, rifle caliber bullets. It should be understood that all such modifications and improvements have been deleted herein for the sake of conciseness and readability but are properly within the scope of the following claims.

We claim:

1. A bullet trap for arresting and trapping a fired bullet, said bullet trap comprising:

(a) a primary enclosure having a shooting port; and (b) a plurality of discrete, resilient bullet trap media in said enclosure; whereby said media are spherical and have a diameter between about ¼ and ¾ inches and are operable to arrest and capture a fired bullet.

2. The apparatus of claim 1, further including a secondary enclosure for containing said plurality of discrete, resilient bullet trap media.

3. The apparatus of claim 2, wherein said secondary enclosure includes sidewalls and a bottom.

4. The apparatus of claim 3 wherein said secondary enclosure has a circular cross-section.

5. The apparatus of claim 3 further including a removable cap on the bottom of said secondary enclosure.

6. The apparatus of claim 2 wherein said secondary enclosure further includes a top.

7. The apparatus of claim 6 further including a sacrificial plug in said top.

8. The apparatus of claim 2 wherein said secondary enclosure is constructed of a resilient material.

9. The apparatus of claim 8 wherein the resilient material is translucent plastic.

10. The apparatus of claim 1 wherein said primary enclosure includes sidewalls and a back opposite the shooting port.

11. The apparatus of claim 10 wherein said primary enclosure has a circular cross-section.

12. The apparatus of claim 10 wherein said back further includes a bullet impact-resistant safety door.

13. The apparatus of claim 12 wherein said door is removable.

14. The apparatus of claim 1, further including a carrying handle attached to said primary enclosure.

15. The apparatus of claim 1 further including end supports attached to said primary enclosure.

16. The apparatus of claim 15, wherein said end supports further include means for attaching said end supports to a surface.

17. The apparatus of claim 1 further including a vent port transecting said primary enclosure.

18. The apparatus of claim 1 further including a safety cover on said shooting port.

19. An improved bullet trap for arresting and trapping a fired bullet, said bullet trap including a primary enclosure having a shooting port; and bullet trap media in said enclosure; whereby said media have a diameter between about ¼ and ¾ inches and are operable to arrest and capture a fired bullet, said improvement comprising: discrete bullet trap media in said primary enclosure which are generally spherical and have a durometer less than or equal to about 100.

20. The apparatus of claim 19 wherein the diameter of said media is about ⅝ inch.

21. The apparatus of claim 19 wherein said media have a durometer greater than about 5.

22. The apparatus of claim 21 wherein said media have a durometer between about 30 and 40.

23. The apparatus of claim 22 wherein said media have a durometer of about 40.

24. The apparatus of claim 19 wherein the volume of said discrete bullet trap media in said enclosure is sufficient to arrest a bullet fired through said shooting port.

25. The apparatus of claim 24 wherein the height of said enclosure is greater than about 3 inches.

26. The apparatus of claim 25 wherein the height of said enclosure is about 16 inches.

27. The apparatus of claim 24 wherein the diameter of said enclosure is greater than about 3 inches.

28. The apparatus of claim 27 wherein the diameter of said enclosure is about 7 inches.

29. A bullet trap for arresting and trapping a fired bullet, said bullet trap comprising:

(a) a primary enclosure having a shooting port;

(b) a plurality of discrete, resilient bullet trap media in said enclosure, which are generally spherical and have a durometer less than or equal to about 100; whereby said media have a diameter between about ¼ and ¾ inches and are operable to arrest and capture a fired bullet; and (c) a secondary enclosure for containing said plurality of discrete, resilient bullet trap media.

30. The apparatus of claim 29, wherein said secondary enclosure includes sidewalls and a bottom.

31. The apparatus of claim 30 wherein said secondary enclosure has a circular cross-section.

32. The apparatus of claim 30 further including a removable cap on the bottom of said secondary enclosure.

33. The apparatus of claim 29 wherein said secondary enclosure further includes a top.

34. The apparatus of claim 33, further including a sacrificial plug in said top.

35. The apparatus of claim 29, wherein said secondary enclosure is constructed of a resilient material.

36. The apparatus of claim 35 wherein the resilient material is translucent plastic.

37. The apparatus of claim 29 wherein said primary enclosure includes sidewalls and a back opposite the shooting port.

38. The apparatus of claim 37 wherein said primary enclosure has a circular cross-section.

39. The apparatus of claim 37 wherein said back further includes a bullet impact-resistant safety door.

40. The apparatus of claim 39 wherein said door is removable.

41. The apparatus of claim 29, further including a carrying handle attached to said primary enclosure.

42. The apparatus of claim 29 further including end supports attached to said primary enclosure.

43. The apparatus of claim 42, wherein said end supports further include means for attaching said end supports to a surface.

44. The apparatus of claim 29 further including a vent port transecting said primary enclosure.

45. The apparatus of claim 29 further including a safety cover on said shooting port.

46. The apparatus of claim 29 wherein the diameter of said media is about ⅝ inch.

47. The apparatus of claim 29 wherein said media have a durometer greater than about 5.

48. The apparatus of claim 47 wherein said media have a durometer between about 30 and 40.

49. The apparatus of claim 48 wherein said media have a durometer of about 40.

50. The apparatus of claim 29 wherein the volume of said discrete bullet trap media in said enclosure is sufficient to arrest a bullet fired through said shooting port.

51. The apparatus of claim 50 wherein the height of said enclosure is greater than about 3 inches.

52. The apparatus of claim 51 wherein the height of said enclosure is about 16 inches.

53. The apparatus of claim 50 wherein the diameter of said enclosure is greater than about 3 inches.

54. The apparatus of claim 53 wherein the diameter of said enclosure is about 7 inches.

55. A method for arresting and capturing a fired bullet, said method comprising the step of: firing said bullet into a primary enclosure having a shooting port and a plurality of discrete, resilient bullet trap media in said enclosure, which are generally spherical and have a durometer less than or equal to about 100; whereby said media have a diameter between about ¼ and ¾ inches and are operable to arrest and capture said fired bullet.

* * * * *